US007262557B1

(12) United States Patent
Wang

(10) Patent No.: US 7,262,557 B1
(45) Date of Patent: Aug. 28, 2007

(54) APPARATUS FOR ILLUMINATING FOOTWEAR

(76) Inventor: Zhong Wang, 1226 Felton St., San Francisco, CA (US) 94134

( * ) Notice: Subject to any disclaimer, the term of this patent is extended or adjusted under 35 U.S.C. 154(b) by 359 days.

(21) Appl. No.: 10/611,192

(22) Filed: Jul. 1, 2003

(51) Int. Cl.
*H05B 37/00* (2006.01)

(52) U.S. Cl. ..... 315/200 A; 315/246; 315/186; 315/119; 36/137; 362/103

(58) Field of Classification Search ..... 315/119, 315/149, 123, 125, 150–151, 156–158, 200, 315/200 A, 323, 325; 362/103, 800, 802; 36/137, 139
See application file for complete search history.

(56) References Cited

U.S. PATENT DOCUMENTS 5,396,720 A * 3/1995 Hwang et al. ..... 36/137
5,408,764 A * 4/1995 Wut ..... 36/137
5,422,628 A * 6/1995 Rodgers ..... 340/573.1
5,500,635 A * 3/1996 Mott ..... 340/323 R
5,599,088 A * 2/1997 Chien ..... 362/103
5,866,987 A * 2/1999 Wut ..... 315/119
5,903,103 A * 5/1999 Garner ..... 315/76
5,909,088 A * 6/1999 Wut ..... 315/200 A
5,932,975 A * 8/1999 Wut ..... 315/119
6,065,851 A * 5/2000 So ..... 362/103
6,104,140 A * 8/2000 Wut et al. ..... 315/200 A
6,164,794 A * 12/2000 Rodgers ..... 362/103
6,175,196 B1 * 1/2001 Ragner et al. ..... 315/200 A
6,619,812 B2 * 9/2003 Rapisarda ..... 362/103
6,776,498 B2 * 8/2004 Yeung ..... 362/103
6,843,578 B1 * 1/2005 Cheung ..... 362/103
2004/0227064 A1 * 11/2004 Linge et al. ..... 250/221

* cited by examiner

*Primary Examiner*—Douglas W. Owens
*Assistant Examiner*—Chuc Tran
(74) *Attorney, Agent, or Firm*—James Cai; Schein & Cai LLP

(57) ABSTRACT

An apparatus for illuminating footwear includes a circuit combining a switch having a resilient spring and a light sensitive switch.

6 Claims, 3 Drawing Sheets

APPARATUS FOR ILLUMINATING FOOTWEAR

BACKGROUND OF THE INVENTION

The present invention generally relates to apparatus for illuminating footwear and more particularly to a circuit for illuminating footwear which includes a circuit combining a switch having a resilient spring and a light sensitive switch.

Apparatus for illuminating footwear are well known in the art. For example, U.S. Pat. No. 4,848,009, "Flashing Footwear" discloses an article of footwear including a battery and a light source and a motion responsive switch to intermittently connect the battery to the light source. The light source is preferable an LED and there is preferably a circuit to extinguish the light after a predetermined interval. The article includes neither a resilient spring nor light sensitive switch, either alone or in combination.

U.S. Pat. No. 6,264,794, "Illuminated Footwear with Acceleration Responsive Random Output Selection" discloses a shoe including a switch having a fixed end for connection to one side of a battery and a movable end for contacting one of a plurality of selectable conducting members each connected to a separate terminal of a sub-circuit. Each sub-circuit contains a source of light or sound with a common terminal at the opposite end from the separate terminal and connected to the other side of the battery. The switch movable end moves substantially randomly or in random patterns under inertia to contact a conducting member to complete a sub-circuit. The shoe includes neither a resilient spring nor light sensitive switch, either alone or in combination As can be seen, there is a need for a circuit for illuminating footwear which includes a circuit combining a switch having a resilient spring and light sensitive switch.

SUMMARY OF THE INVENTION

In accordance with one aspect of the invention, an apparatus for illuminating footwear includes a circuit combining a switch having a resilient spring and a light sensitive switch.

In accordance with another aspect of the invention, a circuit for use in illuminating footwear includes a light sensitive switch and a switch having a resilient spring, the switch having the resilient spring being coupled to the light sensitive switch and being operable to alternatively energize a first lighting device and a second lighting device.

These and other features, aspects and advantages of the present invention will become better understood with reference to the following drawings, description and claims.

DETAILED DESCRIPTION OF THE INVENTION

The following detailed description is of the best mode of carrying out the invention. The description is not to be taken in a limiting sense, but is made merely for the purpose of illustrating the general principles of the invention, since the scope of the invention is best defined by the appended claims.

The present invention generally provides a circuit for illuminating footwear which includes a circuit combining a switch having a resilient spring and a light sensitive switch.

Figure 1:
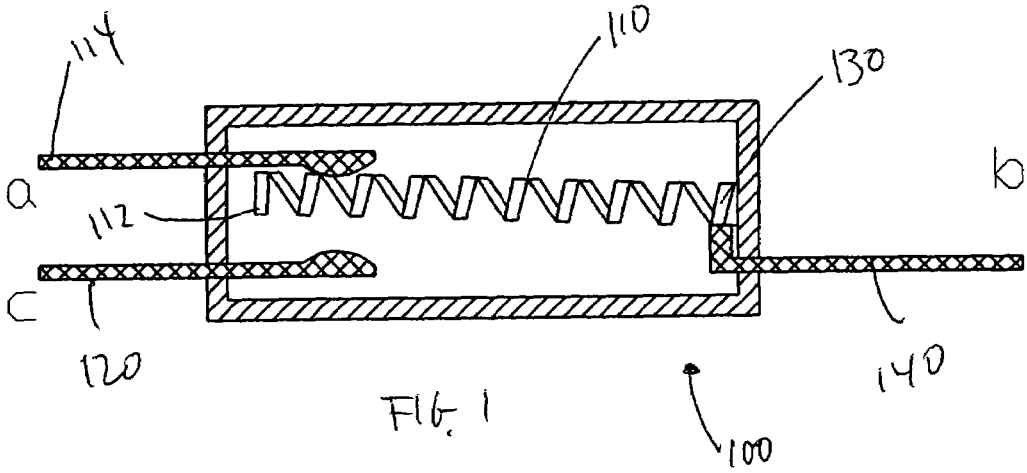
FIG. 1 is a schematic representation of a switch having a resilient spring in an open position in accordance with the present invention.
Figure 2:
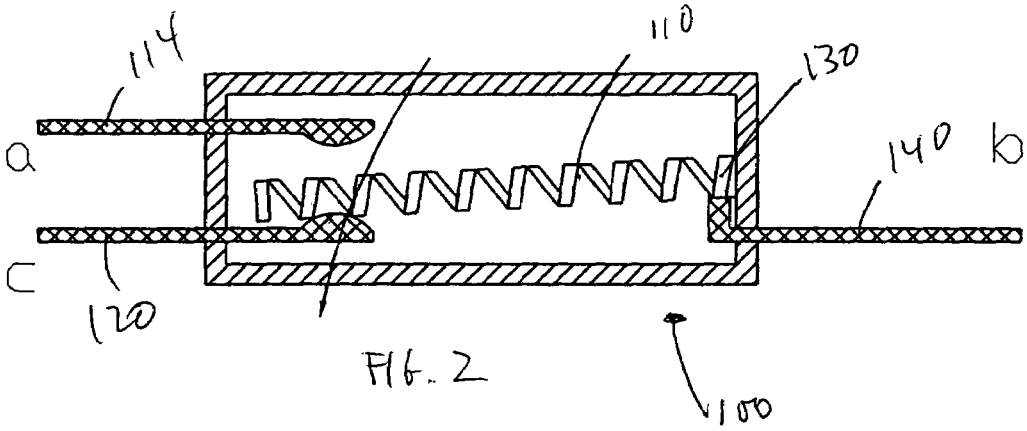
FIG. 2 is a schematic representation of the switch shown in FIG. 1 in a closed position in accordance with the present invention.

With reference to FIGS. 1 and 2, an apparatus in accordance with the invention includes a switch generally designated 100 having a resilient spring 110. Resilient spring 110 is moveable between an open position in which an end 112 of the resilient spring 110 contacts an open contact or detent 114 and a closed position in which the end 112 contacts a closed contact 120. An opposite end 130 of resilient spring 110 is connected to a contact 140. Switch 100 may be positioned in a body of a shoe (not shown) in such manner that motion of the shoe causes resilient spring 110 to move between the open position and the closed position.

Figure 3:
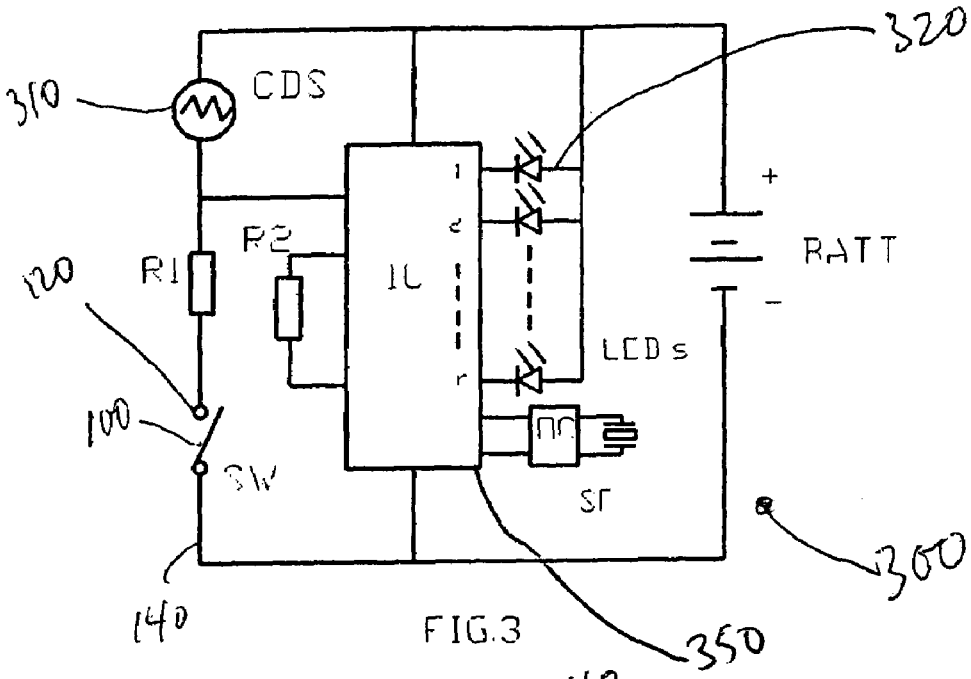
FIG. 3 is a schematic representation of a circuit in accordance with the present invention.

Turning to FIG. 3, a circuit generally designated 300 is shown including the switch 100. Additionally, the circuit 300 includes a light sensitive device or switch 310 including a CdS device or photo resistance device of the type well known in the art. Advantageously, LEDs 320 are energized only when there is sufficient absence of light and switch 100 is in the closed position. LEDs 320 are coupled to switch 100 and light sensitive device 310 through an integrated circuit 350 operable to turn on LEDs 320 when current flows through switch 100 and light sensitive device 310.

Figure 4:
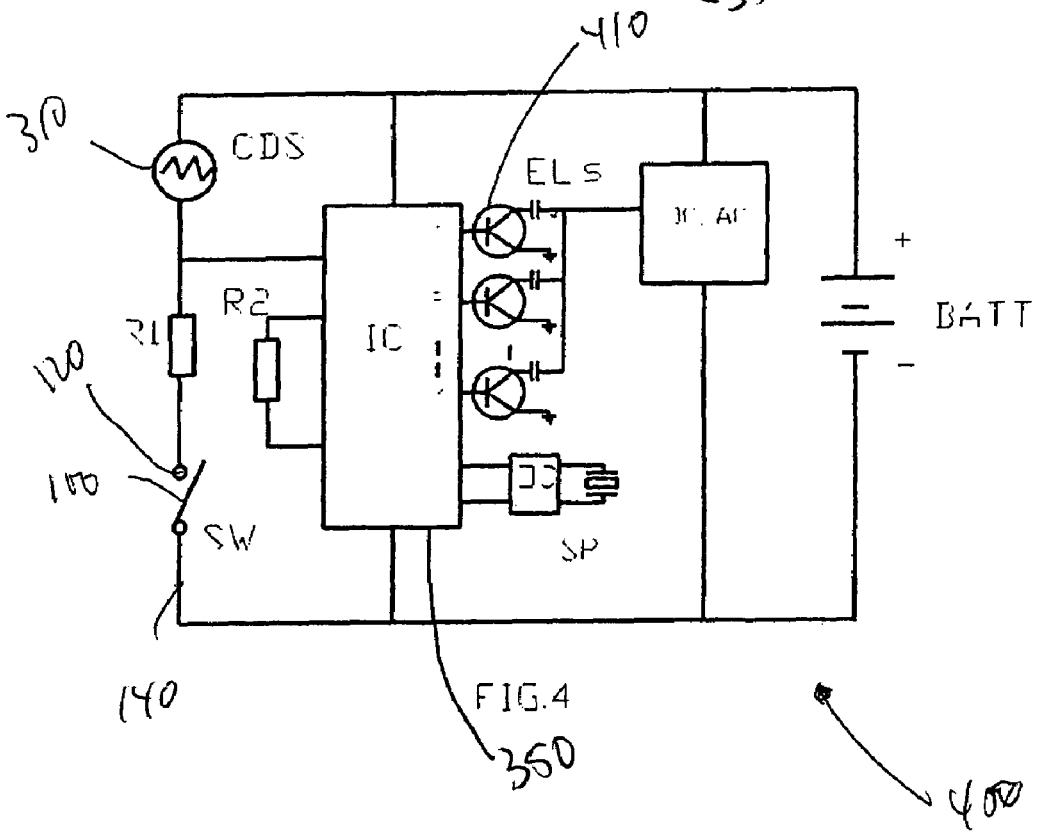
FIG. 4 is a schematic representation of an alternative circuit in accordance with the present invention.

With reference to FIG. 4, an alternative circuit generally designated 400 is shown. Circuit 400 differs from circuit 300 in that LEDs 320 are replaced by electro luminescence or other lighting devices 410.

Figure 5:
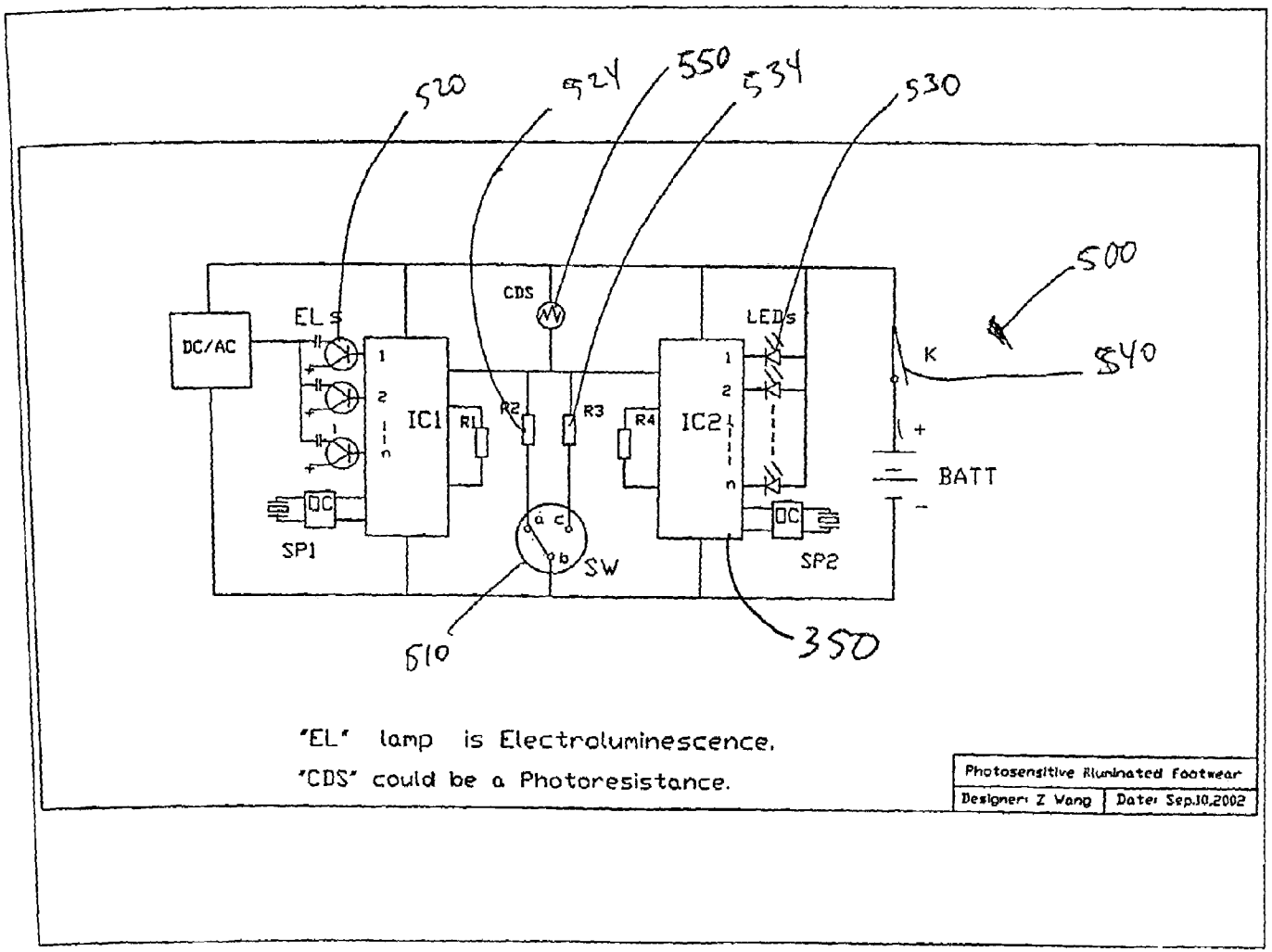
FIG. 5 is a schematic representation of yet another alternative circuit in accordance with the present invention.

With reference to FIG. 5, an alternative circuit generally designated 500 is shown including a switch 510 operable to alternatively energize a first lighting device including a plurality of electro luminescence or other lighting devices 520 through resistor 524 and a second lighting device including a plurality of LEDs 530 through resistor 534. Switch 510 may be a resilient switch such as switch 100. When switch 510 is closed and a shoe (not shown) in which the circuit is disposed is not in motion, switch 510 is operable to energize devices 520. Motion of the shoe causes switch 510 to energize LEDs 530. A light sensitive device or switch, such as a CdS device 550, is shown coupled to the switch 510 for completing the circuit.

In use, circuits 300 and 400 of the invention are operable to illuminate a user's shoe in darkened conditions and when motion of the shoe closes switch 100. Circuit 500 is operable to switch current flow from electro luminescence devices 520 to LEDs 530 upon motion of the shoe.

It should be understood, of course, that the foregoing relates to preferred embodiments of the invention and that modifications may be made without departing from the spirit and scope of the invention as set forth in the following claims.

I claim:

1. A circuit for use in illuminating footwear comprising:

a light sensitive switch; and a switch having a resilient spring, the switch having the resilient spring being coupled to the light sensitive switch and being operable to alternately energize a first lighting device and a second lighting device wherein the resilient spring is positionable between the first lighting device energizing position and the second lighting device energizing position by means of movement of the footwear.

2. The circuit for use in illuminating footwear of claim 1, wherein the light sensitive switch comprises a CdS switch.

3. The circuit for use in illuminating footwear of claim 1, wherein the first lighting device comprises a light emitting diode and the second lighting device comprises an electro luminescence device.

4. A circuit for use in illuminating a shoe comprising:

a first lighting device operable to illuminate when energized;

a second lighting device operable to illuminate when energized;

a light sensitive switch; and a switch having a resilient spring, the resilient spring being coupled to the light sensitive switch and having a first terminal for energizing the first lighting device and a second terminal for energizing the second lighting device and which switches between the first terminal and the second terminal responsive to movement of the shoe to alternately energize one of the first lighting device and the second lighting device.

5. The circuit for use in illuminating the shoe of claim 4, wherein the light sensitive switch comprises a CdS switch.

6. The circuit for use in illuminating the shoe of claim 4, wherein the first lighting device comprises a light emitting diode and the second lighting device comprises an electro luminescence device.

* * * * *